US006587777B1

(12) United States Patent
St. Pierre

(10) Patent No.: US 6,587,777 B1
(45) Date of Patent: Jul. 1, 2003

(54) SYSTEM AND METHOD FOR LOCATION BASED TRAFFIC REPORTING

(75) Inventor: Robert P. St. Pierre, Sunnyvale, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 255 days.

(21) Appl. No.: 09/694,707

(22) Filed: Oct. 23, 2000

(51) Int. Cl.[7] ..... G08G 1/00

(52) U.S. Cl. ..... 701/117; 455/456; 455/457; 455/45; 701/213

(58) Field of Search ..... 455/456, 457, 455/412, 45, 184.1, 186.1; 701/117, 213

(56) References Cited

U.S. PATENT DOCUMENTS 5,812,069 A * 9/1998 Albrecht et al. ..... 701/117
5,908,464 A * 6/1999 Kishigami et al. ..... 701/208
6,236,933 B1 * 5/2001 Lang ..... 701/117
6,256,577 B1 * 7/2001 Graunke ..... 701/117
6,313,761 B1 * 11/2001 Shinada ..... 340/995
6,317,684 B1 * 11/2001 Roeseler et al. ..... 701/202
6,466,862 B1 * 10/2002 DeKock et al. ..... 701/117

OTHER PUBLICATIONS

Zhaosheng Yang et al., A Framework of Telecommunication Subsystem for Urban Traffic Flow Guidance Systems (UTFGS), IEEE, vol.: 1, Sep. 6–9, 1999, pp. 371–374.*

* cited by examiner

*Primary Examiner*—William Trost
*Assistant Examiner*—Earl J. Moorman, III
(74) *Attorney, Agent, or Firm*—Lahive & Cockfield, LLP

(57) ABSTRACT

The illustrated embodiment of the present invention provides an efficient means of obtaining traffic information selectively tailored to a motor vehicle's current location. It allows additional detail to be transmitted to the occupant of a motor vehicle as a result of a smaller geographic area being reported. The use of the current motor vehicle location allows the present invention to omit extraneous information that is of limited interest to the occupant of the motor vehicle because it is outside the intended path of travel. The illustrated embodiment also allows for a dynamic real time updating of traffic conditions as they change over the course of time.

24 Claims, 6 Drawing Sheets

SYSTEM AND METHOD FOR LOCATION BASED TRAFFIC REPORTING

TECHNICAL FIELD

This invention relates generally to the provision of traffic information to motor vehicles, and more particularly to the provision of traffic information regarding areas adjacent to the current location of a motor vehicle.

BACKGROUND OF THE INVENTION

Current methods of providing traffic information to the occupants of motor vehicles involve a generalized broadcast of information. The most common of these methods is a radio broadcast which is transmitted to any motor vehicle able to receive the radio signal and which contains information designed to appeal to a majority of the broadcast's listeners. An additional method for obtaining information about current traffic conditions involves telephoning traffic "hotlines" and receiving information regarding the traffic on various highways. Such information typically will provide current traffic information regarding traffic conditions on a stretch of highway, usually concentrating more closely on highways in urban areas with high volume traffic patterns. Similarly, available methods for computer access to traffic information focus on conditions affecting large geographical areas. Because the current methods of providing traffic information are designed to appeal to as many people as possible, they tend to lack detailed information regarding the driver's immediate area and instead include information that is not germane to a driver because the driver isn't near the reported location.

SUMMARY OF THE INVENTION

The illustrated embodiment of the present invention addresses the deficiencies that exist in the available current methods of disseminating traffic information to occupants of motor vehicles. The present invention allows an occupant of a motor vehicle to obtain information regarding the traffic conditions in the area immediately surrounding their motor vehicle. The present invention also allows the display device in the motor vehicle to control the size of the geographic area for which traffic information is received. Because the information is confined to a specific area, a correspondingly greater level of detail regarding traffic conditions is provided than would be received in conventional traffic reports.

In one embodiment of the present invention, a network is located within a motor vehicle. Connected to this network are a global positioning satellite receiver, a display device and a server with a network interface. This embodiment also includes a second remote server that is accessible by the server located within the motor vehicle. The remote server is in contact with a database of current traffic information. The display device makes a request for current traffic information via the motor vehicle server to the remote server. The request format allows the size of the area adjacent to the motor vehicle, the area for which traffic information is desired, to be specified in the request. The request includes the motor vehicle's current location which was previously retrieved from the global positioning satellite. Optionally, the request will also include the motor vehicle's current heading and speed, also retrieved from the global positioning satellite receiver. The remote server uses the motor vehicle's current location and accesses the database of current traffic information. The remote server will retrieve any current traffic reports falling within the geographical area specified in the request and returns the information to the display device located within the motor vehicle. The information is then conveyed to the occupant of the motor vehicle via the display device.

In an alternative embodiment of the present invention, a network is located within a motor vehicle. Connected to this network is a global positioning satellite receiver, a display device and an electronic device with a network interface connected to the Internet. The alternative embodiment also includes a remote server which is accessible by the electronic device located within the motor vehicle. The remote server is in contact with a database of current traffic information. The display device makes a request for current traffic information via the electronic device to the remote server. The request format allows the size of the area adjacent to the motor vehicle, the area for which traffic information is desired, to be specified in the request. The request includes the motor vehicle's current location which was previously retrieved from the global positioning satellite. Optionally, the request will also include the motor vehicle's current heading and speed, also retrieved from the global positioning satellite receiver. The remote server uses the motor vehicle's current location and accesses the database of current traffic information. The remote server will retrieve any current traffic reports falling within the geographical area specified in the request and returns the information to the display device located within the motor vehicle. The information is then conveyed to the occupant of the motor vehicle by the display device.

In another embodiment of the present invention, a network is located within a motor vehicle. Connected to this network are a global positioning satellite receiver, a display device and a server with a network interface. This embodiment also includes a wide area network (WAN) that is accessible by the server located within the motor vehicle. The wide area network is in contact with a database of current traffic information. The display device makes a request for current traffic information via the motor vehicle server to the wide area network. The request format allows the size of the area adjacent to the motor vehicle, the area for which traffic information is desired, to be specified in the request. The request includes the motor vehicle's current location which was previously retrieved from the global positioning satellite. Optionally, the request will also include the motor vehicle's current heading and speed, also retrieved from the global positioning satellite receiver. The invention uses the motor vehicle's current location and accesses the database of current traffic information. Current traffic reports falling within the geographical area specified in the request are sent from the wide area network to the to the display device located within the motor vehicle. The information is then conveyed to the motor vehicle network and then to the display device.

DETAILED DESCRIPTION OF THE INVENTION

The illustrative embodiment of the present invention allows an occupant of a motor vehicle to obtain, specific traffic information regarding the area immediately adjacent to the motor vehicle. The invention allows the occupant of the motor vehicle to specify the size of the area about which the vehicle will receive traffic information. Thus, the occupant of a motor vehicle can obtain traffic information for only a few miles around the vehicle, or the occupant can obtain information covering an entire highway route. The amount of detail provided in the traffic information is greater than is typically received in conventional traffic reports, because it has been tailored to fit a smaller geographic area surrounding a single motor vehicle and extraneous traffic information therefore can be omitted. The motor vehicle location is pinpointed using a well known global positioning satellite receiver device which makes contact with a group of satellites in orbit around the earth in order to determine the motor vehicle's current location. The current motor vehicle location is then incorporated into a request for traffic information, and the response is tailored to that current location.

Figure 1:
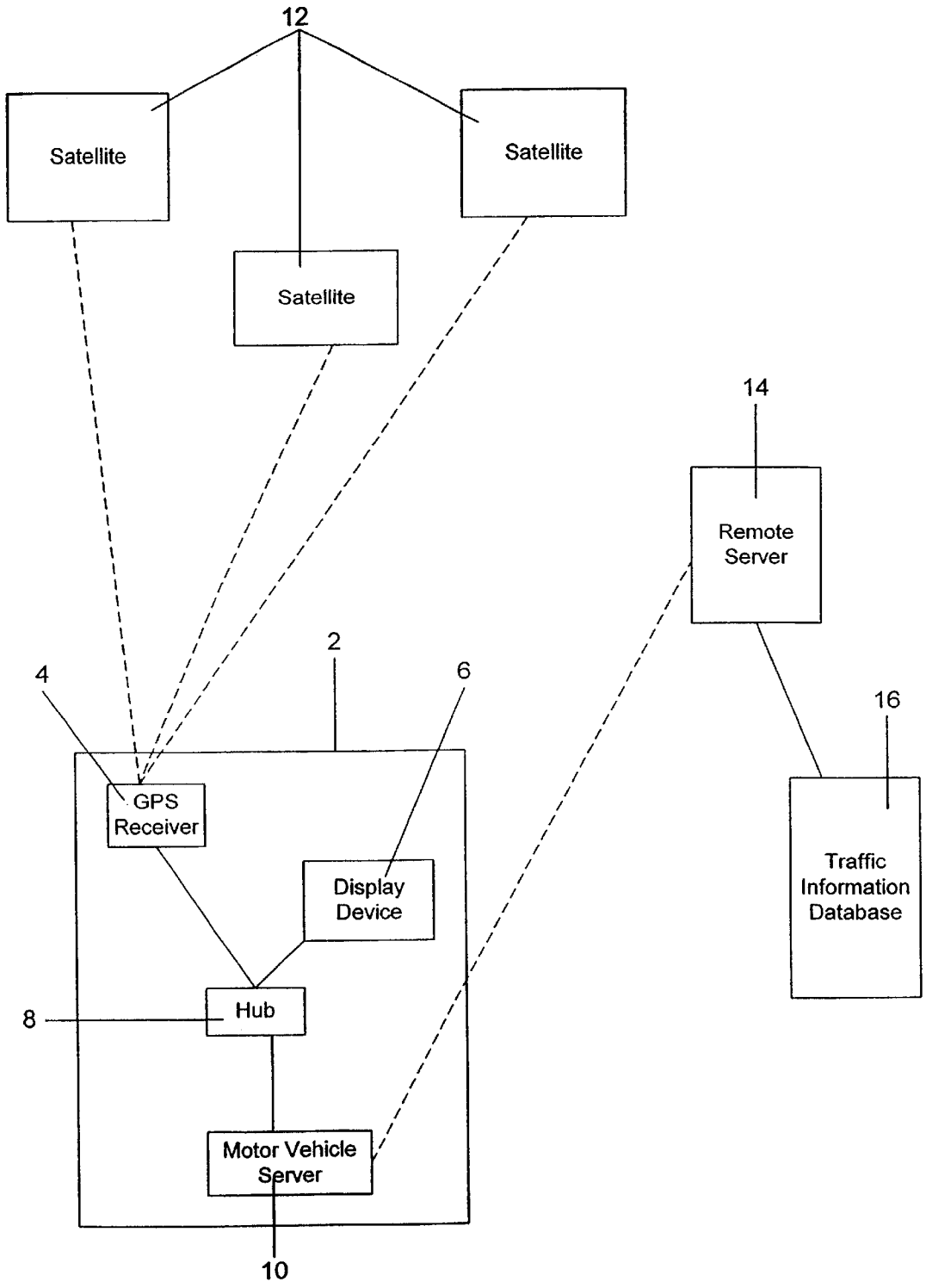
FIG. 1 is a block diagram of an illustrated embodiment of the present invention.

FIG. 1 depicts a block diagram of an environment suitable for practicing the illustrated embodiment of the present invention. A motor vehicle 2 contains a global positioning satellite receiver 4, a display device 6, a network hub 8, and a motor vehicle server 10. The global positioning satellite receiver 4 interacts with a plurality of satellites 12 which are used to triangulate the current position of the motor vehicle. The motor vehicle server 10 includes a network interface which allows it to contact a remote server 14 over the Internet. The motor vehicle server 10 performs all the functions typically performed by a server in a local area network (LAN), it just is located within the confines of the motor vehicle. Those skilled in the art will recognize that the motor vehicle server 10 does not need to be present as long as the hub is connected to another device providing Internet connectivity such as an 802.11 bridge. The remote server 14 is located on its own network distinct from the motor vehicle network. The remote server 14 can be located anywhere as long as it is outside the motor vehicle and is in contact with a Traffic Information Database 16 which contains updated traffic information and is connected to the Internet. Those skilled in the art will further realize that the Traffic Information Database 16 need not be connected to a single land based server, but rather may be connected to a wide area network (WAN) capable of being accessed by the display device 6 located in the motor vehicle 2. Those practiced in the art will further recognize that the network configurations depicted herein are specific examples out of a multitude of possible network configurations.

Figure 2A:
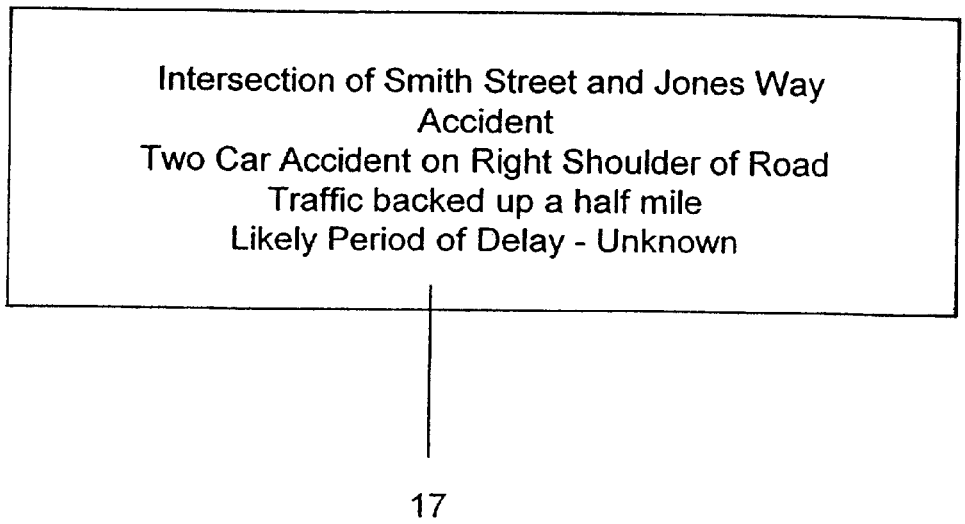
FIG. 2A depicts a scrolling LCD text display device in the illustrated embodiment.
Figure 2B:
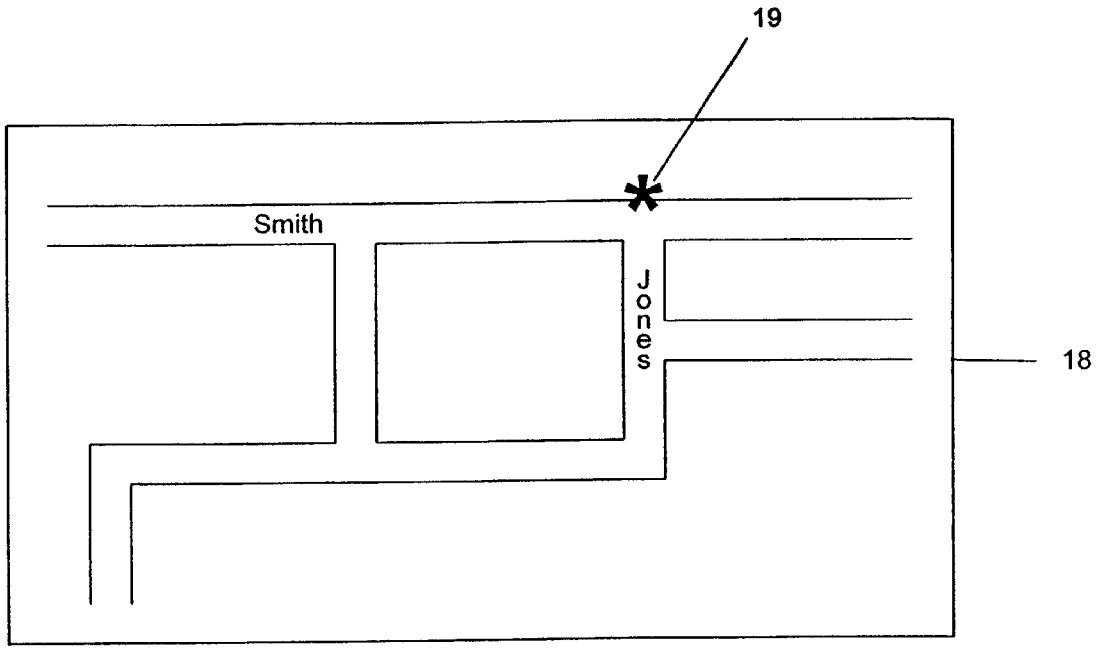
FIG. 2B depicts a visual dashboard display device in the illustrated embodiment.

The display device 6 displays current traffic information received by the motor vehicle 2 in a number of different formats. FIG. 2A depicts the display device 6 displaying traffic information on a scrolling text LCD display 17. FIG. 2B depicts the display device 6 as a visual dashboard 18 displaying graphical images of the traffic information. In such a method, images of the streets and accident location 19 are represented. In another method, the embodiment of the present invention uses a voice synthesis process to audibly deliver the traffic information to the occupant of the motor vehicle. Those skilled in the art will recognize that once the display device has received the traffic information, there are a number of different ways in which the information can be conveyed to the occupant of the motor vehicle without departing from the scope of the present invention.

The Traffic Information Database 16 contains reports on current traffic conditions such as accidents, construction sites and volume delays. The Traffic Information Database 16 contains traffic information including the time the traffic condition was reported, the GPS coordinates of the incident, a text description of the location (such as "the intersection of Jones Street and Smith Way"), the type of incident (such as "accident" or "construction"), a description of the incident (such as "two car accident on left shoulder"), optionally the effect on traffic (such as "backed up four miles"), and the expected duration of the problem (such as "delay expected for 30 minutes"). Information collected from available sources is formatted to include as many of these features as possible. This information is conveyed to the operator of the requesting motor vehicle in a number of ways, including the methods depicted in FIG. 2A and FIG. 2B.

Figure 3:
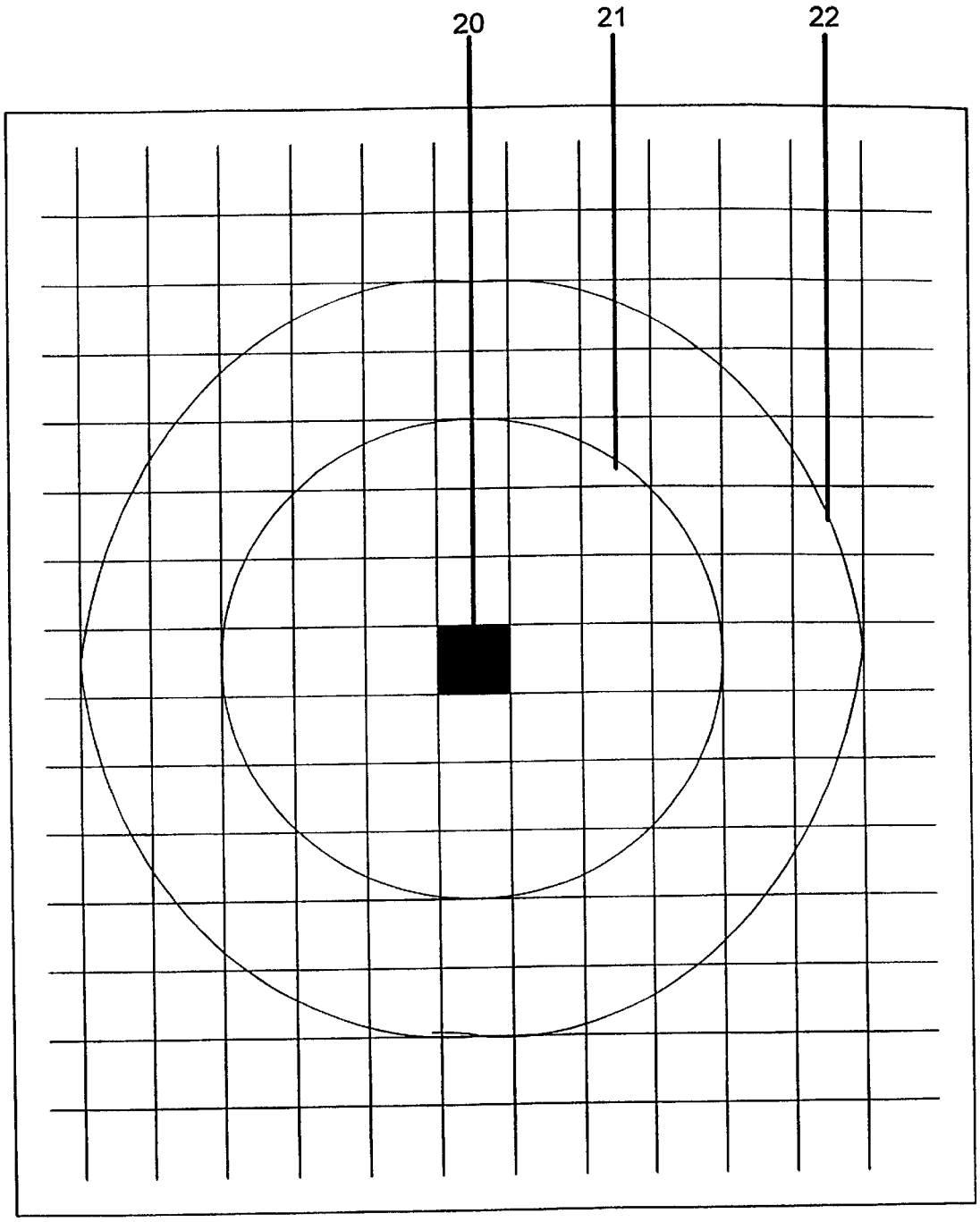
FIG. 3 is a map depicting the ability of the illustrated embodiment to adjust a request for traffic information for different sized areas immediately adjacent to a motor vehicle.

FIG. 3 depicts the ability of the present invention to specify the amount of traffic information that is needed by specifying a range for the traffic information request. Specifically, the occupant of a motor vehicle is able to specify how large a radius from the vehicles current position should be included in the requested traffic information. In a city with a grid-like pattern of streets as depicted in FIG. 3, the current location of a motor vehicle 20 is indicated by the global positioning satellite receiver 4 in the motor vehicle 2. As part of the request being sent to the remote server 14 for traffic information, the occupant of the motor vehicle is able to indicate how large a radius in all directions he wishes to receive information for. In one instance of the present invention, the request indicates a distance equivalent to three city blocks 21. In another instance, the request indicates that the occupant of a motor vehicle wishes to receive information for a radius of five city blocks 22. The radius supplied in the request as a parameter may be a distance measurement rather than a city block. It is important to realize that the occupant of the motor vehicle is not required to affirmatively select a radius parameter for the traffic information request. The display device 2 contains a default radius distance which will be included with the traffic information request in the absence of an affirmative request by an occupant of the motor vehicle such as 1 mile, 5 miles or 10 miles. The present invention only requires the occupant of the motor vehicle to turn the display device on, after which, traffic information is received automatically.

Figure 4:
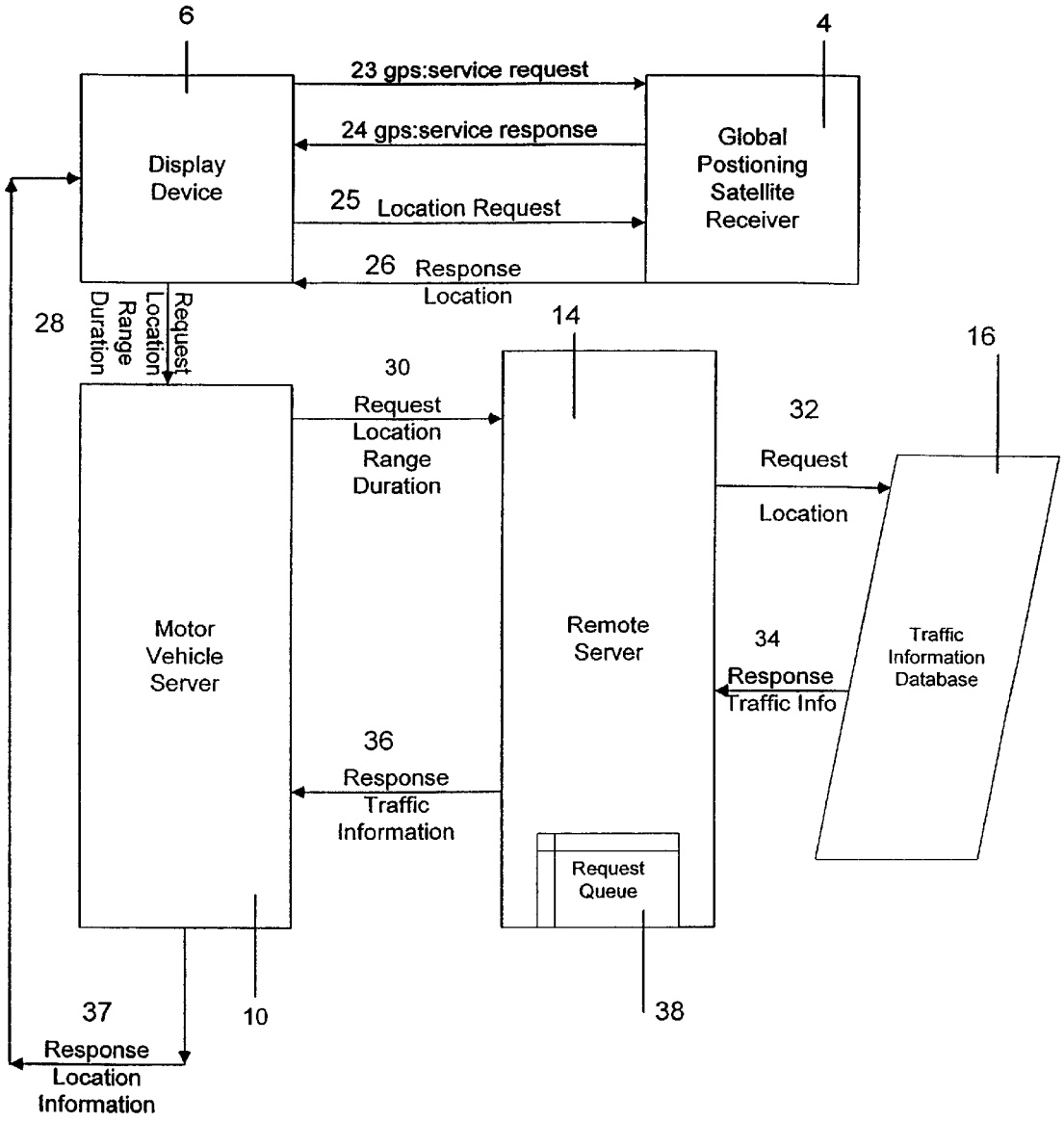
FIG. 4 depicts an overview of the traffic request process of a display device in a motor vehicle practicing the illustrated embodiment of the present invention.

FIG. 4 depicts an overview of the process by which the occupant of a motor vehicle 2 receives traffic information from a remote server 14. The display device 6 in the motor vehicle 2 multicasts a Service Location Protocol (SLP) request for a global positioning satellite service 23 in order to verify the presence and location of a global positioning satellite receiver on the motor vehicle network.

The Service Location Protocol (SLP) is a protocol established by the Internet Engineering Task Force (IETF) that simplifies the discovery of network resources. The protocol utilizes the concept of User Agents and Service Agents. Applications running on a computer are represented by User Agents which understand the service and resource needs of the application. In the case of the illustrative embodiment, the display device 6 is represented by a User Agent. Each network device is represented by a Service Agent. The global positioning satellite receiver 4 of the present invention is represented by a Service Agent. Each Service Agent is aware of the attributes of its corresponding device. An attribute is a characteristic that can be used to distinguish one device from another. For example an attribute for a printer is color capability. Another attribute for the printer is its location. When a User Agent needs a particular service, it sends out a service request which includes both the type of service and attributes desired. In the case of the present invention, the User Agent for the display device 6 multicasts for service: GPS service request 23 when it wishes to request global positioning satellite data from a GPS receiver 4. The Service Agent for the global positioning satellite receiver 4 responds with its Uniform Resource Locator (URL) address 24. Once the presence of a GPS receiver 4 has been verified, the display device 6 sends a location request 25 to the GPS receiver. The motor vehicle's current location will be used to obtain traffic information relevant to the vehicle.

The global positioning satellite receiver 4 calculates the motor vehicle's position by reflecting a signal off of a number of global positioning satellites 12 at known, fixed points in space and triangulating the motor vehicle's current position based on the angle of the return signal and on the amount of time the return signal takes to arrive. Some global positioning satellite receivers 4 also provide the motor vehicle's heading and speed. The global positioning satellite receiver 4 obtains the motor vehicles current location and provides it back to the display device 6 with a location request response 26. The display device 6 then forwards a traffic information request 28 to the motor vehicle server 10 for transmission to the remote server 14. The motor vehicle server 10 transmits the traffic information request 30 to the remote server 14. The traffic information request 28 generated by the display device 6 includes the motor vehicle's current location, received from the global positioning satellite receiver 4, instructions to the remote server on the requested range of traffic information, and instructions to the remote server on the duration of time the request will remain valid.

Upon receiving the traffic information request 28 which was forwarded by motor vehicle server 30, the remote server 14, sends its own request 32 to the Traffic Information Database 16. The remote server's request 32 is accompanied by the current location of the motor vehicle. The Traffic Information Database 16 responds to the traffic information request 32 with a traffic information response 34 that contains traffic information impacting the location contained in the traffic information request 28. The remote server 14 responds with a traffic information response 36 sent to the motor vehicle server 10. The responses include "no traffic incidents reported", a series of traffic incident reports, an end of report message which is sent after at least one traffic incident report and indicates that no further traffic information is forthcoming from the remote server at the present time, and a traffic server unavailable. The motor vehicle server 10 transmits 37 the traffic information response 36 to the display device 6. The remote server 14 saves the original request in a request queue 38 located on the remote server. The saved request contains a duration parameter indicating the length of time the request remains valid. Subsequent changes in traffic conditions that generate changes to the Traffic Information Database 16 will cause the request queue 38 to be searched for valid traffic information requests that contain duration parameters that have not expired.

Figure 5:
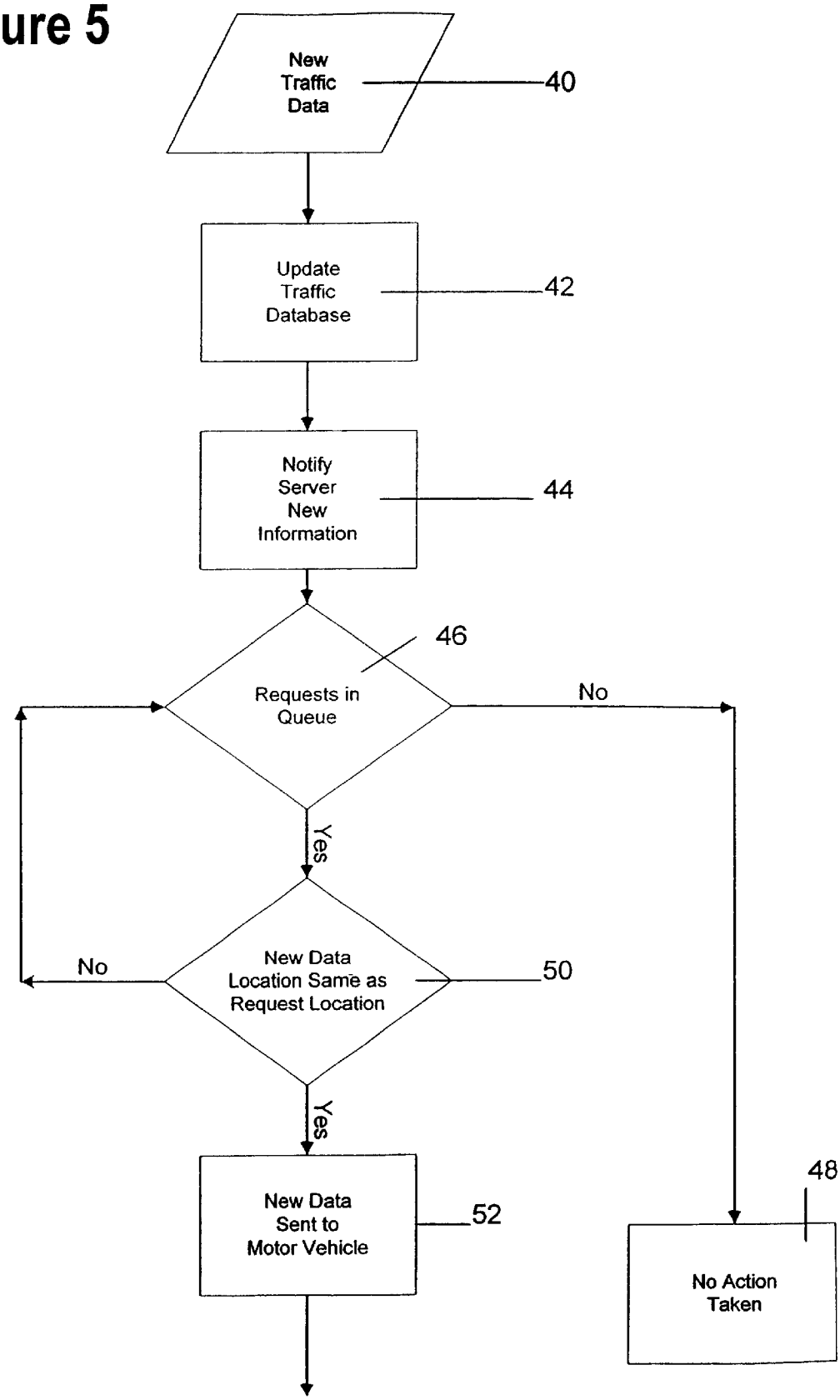
FIG. 5 depicts the flow of information in the traffic information update process in the present invention.

FIG. 5 depicts the process by which the illustrated embodiment transmits relevant updated traffic information to a motor vehicle that has already received an initial traffic information report. The Traffic Information Database 16 is updated (step 42) whenever new traffic data 40 is received by the remote server's network. Once the Traffic Information Database 16 has been updated (step 42), the remote server is notified that new traffic data 40 has arrived (step 44). Upon being notified that new traffic information has arrived (step 44) the remote server 14 checks the request queue (step 46) to see if it contains any traffic information requests. If there are no traffic information requests in the request queue 38 the remote server takes no action (step 48) on the new traffic data 40. If the traffic information request in the request queue 38 has expired, the request is expelled from the queue. A request is determined to be expired if the original time of the request plus the duration parameter, which is an element of time, are earlier than the current time. For example, if the original request occurred at 1:00 and the duration parameter was a half-hour, the request remains valid until 1:30. If updated traffic information is received by the Traffic Information Database 16 at 2:00, the request is discarded from the request queue because it has expired. Conversely, if the updated traffic information is received by the Traffic Information Database 16 at 1:15, the traffic information request is still active and the location information contained in the traffic information request 28 stored in the request queue 38 is examined.

If the request queue 38 contains active traffic information requests, the remote server 14 compares the location of the new traffic data 40 with the location information contained in the traffic information requests stored in the queue (step 50). If the original request contained heading and speed information for the motor vehicle, the heading, speed and passage of time since the request was originally made are used to determine an updated motor vehicle location which is compared with the traffic information location in the new traffic data 40 to determine if the new traffic information impacts the area referenced in the traffic information request 28. In the event that the locations do not match, the remote server 14 will return again to check the request queue 38 to see if there are any requests currently pending (step 46). If there are requests pending, the process will repeat. If there are not any requests pending, no action will be taken (step 48) to distribute the new traffic information. The present invention only distributes traffic information to the vehicles to which it will be relevant, relevance being defined by the parameters contained in pending traffic information requests. In the event that the comparison of locations (step 50) reveals the new traffic data 40 to be traffic information impacting a requested location, then the new traffic data is sent to the motor vehicle (step 52). Periodically, the display device in the motor vehicle will issue a new request to the remote server 14 and the new request will replace the old request in the request queue 38.

It will thus be seen that the invention efficiently attains the objects made apparent from the preceding description. Since certain changes may be made without departing from the scope of the present invention, it is intended that all matter contained in the above description and shown in the accompanying drawings be interpreted as illustrative and not in a literal sense. Practitioners of the art will realize that the network configurations and hardware devices connected to the networks may be modified without departing from the scope and spirit of the invention.

What is claimed is:

1. In a network located in a motor vehicle, said network including a global positioning satellite receiver, a separate display device, and a first server located within said motor vehicle, a method comprising the steps of:

providing a second server located outside of said motor vehicle, said second server connected to a database of information on current traffic conditions and to a Wide Area Network (WAN);

transmitting a request for traffic information accompanied by the current motor vehicle location to said second server via said first server; said request for traffic information specifying a size of an area adjacent to the motor vehicle through the inclusion of a distance parameter in said request for traffic information, said area being the locations for which traffic information is requested; and receiving a response containing current traffic information for said current motor vehicle location and said specified area from said second server.

2. The method of claim 1, said method comprising the further step of:

receiving a current compass heading and current speed of said motor vehicle from said global positioning satellite receiver; and incorporating said current compass heading and said current speed of said motor vehicle as part of said request for traffic information.

3. The method of claim 1, said method comprising the further steps of:

specifying a length of time to receive traffic information updates through the use of a duration parameter contained in said request for traffic information, said duration parameter indicating the amount of time said request for traffic information will remain active; and storing said request for information in a memory queue.

4. In a network located in a motor vehicle, said network including a global positioning satellite receiver, a separate display device, and a first server located within said motor vehicle, a method comprising the steps of:

providing a second server located outside of said motor vehicle, said second server interfaced with a database of information on current traffic conditions and the Internet;

transmitting a request for traffic information accompanied by the current motor vehicle location to said second server via said first server, said request specifying a length of time to receive traffic information updates through the use of a duration parameter contained in said request for traffic information, said duration parameter indicating the amount of time said request for traffic information will remain active, said request for information being stored in a memory queue accessible to said second server;

receiving a response containing current traffic information for said current motor vehicle location from said second server;

examining said memory queue in response to said traffic information database receiving updated traffic information to determine if any requests for traffic information are still active, said examining comprising scrutinizing said duration parameter of each request for traffic information; and discarding from said memory queue any request for traffic information which has an expired duration parameter, said expired duration parameter being less than the elapsed amount of time between the time of the request for traffic information and the time of said examining.

5. The method of claim 4 wherein a request for traffic information in said memory queue has not expired and said method comprises the further step of:

comparing location information contained in said request for traffic information with the location contained in said new traffic information.

6. The method of claim 5 wherein said comparing of location information adjusts the location contained in said request for traffic information by a current speed and a current compass heading of the motor vehicle and the elapsed amount of time since the original request for traffic information.

7. The method of claim 6 wherein a location indicated in said new traffic information is included in an area for which traffic information was requested, said area specified in the request for traffic information as the motor vehicle location offset with a distance parameter, said method further comprising the step of:

sending updated traffic information to said motor vehicle from said second server.

8. The method of claim 4, comprising the further step of:

conveying said traffic information to an occupant of said motor vehicle.

9. The method of claim 4, comprising the further step of:

specifying a size of an area adjacent to the motor vehicle in the request for traffic information through the use of a distance parameter in the request for traffic information, said area being the locations for which traffic information is requested.

10. In a network located in a motor vehicle, said network located in a motor vehicle including a global positioning satellite receiver, a separate display device, and a first electronic device, a method comprising the steps of:

providing a second electronic device located outside of said motor vehicle, said second electronic device interfaced with a database of information on current traffic conditions and a second network, said second network being an external network located outside said motor vehicle;

transmitting a request for traffic information accompanied by the current motor vehicle location to said second electronic device via said first electronic device, said request specifying a length of time to receive traffic information updates through the inclusion of a duration parameter contained in said request for traffic information, said duration parameter indicating the amount of time said request for traffic information will remain active, said request being stored in a memory queue accessible to said second server;

receiving a response containing current traffic information for said current motor vehicle location from said second electronic device;

examining said memory queue to determine if any requests for traffic information are still active in response to said traffic information database receiving updated traffic information, said examining comprising scrutinizing said duration parameter of each request for traffic information; and discarding from said memory queue any request for traffic information which has an expired duration parameter, said expired duration parameter being less than the elapsed amount of time between the time of the request for traffic information and the time of said examining.

11. The method of claim 10 said method further comprising the step of:

specifying a size of an area adjacent to the motor vehicle in said request for traffic information, said specification occurring through the inclusion of a distance parameter in said request for traffic information, said area being the locations for which traffic information is requested.

12. The method of claim 10 wherein a request for traffic information in said memory queue has not expired and said method further comprises the step of:

comparing location information contained in said request for traffic information with the location contained in said new traffic information.

13. The method of claim 12 wherein said comparing of location information adjusts the location contained in said request for traffic information by a current speed and a current compass heading of the motor vehicle and the elapsed amount of time since the original request for traffic information.

14. The method of claim 13 wherein a location indicated in said new traffic information is included in an area for which traffic information was requested, said area specified in the request for traffic information as the motor vehicle location offset with a distance parameter, said method further comprising the step of:

sending updated traffic information to said motor vehicle from said second electronic device.

15. The method of claim 10 wherein said updated traffic information is conveyed to an occupant of said motor vehicle using at least one of a scrolling LCD display, a virtual car dashboard and voice synthesization.

16. The method of claim 10 wherein said external network is one of a Wide Area Network and the Internet.

17. In a network located in a motor vehicle, said network located in a motor vehicle including a global positioning satellite receiver, a separate display device, and a first electronic device, a method comprising the steps of:

providing a second network external to said motor vehicle, said external network interfaced with a database of information on current traffic conditions;

transmitting a request for traffic information accompanied by the current motor vehicle location to said external network from said motor vehicle, said request specifying a size of an area adjacent to the motor vehicle, said specification occurring through the inclusion of a distance parameter in said request for traffic information, said area being the locations for which traffic information is requested; and receiving a response containing current traffic information for said current motor vehicle location at said motor vehicle from said external network.

18. The method of claim 17 wherein said display device receives the current motor vehicle location from said global positioning satellite receiver prior to making said request for traffic information and incorporates said location into said request for traffic information.

19. The method of claim 17 said method further comprising the step of:

specifying a length of time to receive traffic information updates through the inclusion of a duration parameter in said request for traffic information, said duration parameter indicating the amount of time said request for traffic information is to remain active; and storing said request for traffic information in a location accessible to said second electronic device.

20. The method of claim 19, said method further comprising the step of:

examining said stored request to determine if said request is still active in response to said traffic information database receiving updated traffic information, said examining comprising scrutinizing said duration parameter of said request for traffic information; and discarding any request for traffic information which has an expired duration parameter, said expired duration parameter being less than the elapsed amount of time between the time of the request for traffic information and the time of said examining.

21. The method of claim 20 wherein said stored request for traffic information remains active and said method further comprises the step of:

comparing location information contained in said request for traffic information with the location contained in said new traffic information.

22. The method of claim 21 wherein said comparing of location information adjusts the location contained in said request for traffic information by a current speed and a current compass heading of the motor vehicle and the elapsed amount of time since the original request for traffic information.

23. The method of claim 22 wherein a location indicated in said new traffic information is included in an area for which traffic information was requested, said area specified in the request for traffic information as the motor vehicle location offset with a distance parameter, said method further comprising the step of:

sending updated traffic information to said motor vehicle.

24. The method of claim 17 wherein said external network is one of a Wide Area Network and the Internet.

* * * * *